United States Patent [19]

Sluyterman

[11] Patent Number: 4,524,340

[45] Date of Patent: Jun. 18, 1985

[54] DEVICE FOR DISPLAYING TELEVISION PICTURES

[75] Inventor: Albertus A. S. Sluyterman, Eindhoven, Netherlands

[73] Assignee: U.S. Philips Corporation, New York, N.Y.

[21] Appl. No.: 606,118

[22] Filed: May 2, 1984

[30] Foreign Application Priority Data

May 2, 1983 [NL] Netherlands ..... 8301534

[51] Int. Cl.[3] ..... H01F 1/00

[52] U.S. Cl. ..... 335/212; 335/210; 313/426

[58] Field of Search ..... 335/210, 212, 213; 313/421, 426, 427

[56] References Cited

U.S. PATENT DOCUMENTS 4,231,009 10/1980 Barkow ..... 335/212

4,253,078 2/1981 Tagawa et al. ..... 335/212

4,409,578 10/1983 Beelaard et al. ..... 335/212 X

*Primary Examiner*—George Harris

*Attorney, Agent, or Firm*—Thomas A. Briody; William J. Streeter

[57] ABSTRACT

A device for displaying television pictures having a deflection unit which is placed on a display tube and which comprises a line deflection coil system and a field deflection coil system, both with coils of the saddle type. At the gun end the field deflection coil system has two diametrically oppositely located 'V' shaped members of a soft magnetic material, the limbs of which extend towards the neck of the display tube while the arcuate transverse portion of each 'V' member bridges corresponding parts of adjacent longitudinal winding packets of the field deflection coil at the gun end of the deflection unit.

6 Claims, 15 Drawing Figures

DEVICE FOR DISPLAYING TELEVISION PICTURES

BACKGROUND OF THE INVENTION

1. Field of the Invention

The invention relates to a device for displaying television pictures comprising a display tube, the neck of which contains an electron gun system for emitting at least one electron beam towards a display screen. A deflection unit is mounted coaxially about the display tube, which deflection unit comprises a line deflection coil system which when energized deflects the electron beam(s) in a first direction and a field deflection coil system which when energised deflects the electron beam(s) in a second direction transverse to the first direction, the said field deflection coil system comprising two field deflection coils each of the saddle type situated diametrically with respect to each other, each deflection coil comprising a plurality of conductors forming first and second lateral winding packets extending in the longitudinal direction of the deflection unit which substantially coincides with the direction of the longitudinal axis of the display tube. An arcuate front end section and an arcuate rear end section together define a window. The invention also relates to a deflection unit for use with such a display device.

In monochrome display tubes the electron gun system is designed to generate one electron beam, whereas in colour display tubes of the inline type the electron gun system is designed to generate three coplanar electron beams which converge on the display screen.

2. Description of the Prior Art

The deflection unit placed around the display tube and destined to deflect the electron beams is used to deflect the electron beams in one or in the opposite direction away from their normal undeflected straight path, so that the beams impinge on selected points of the display screen to provide visual indications thereon. By suitably varying the magnetic deflection fields, the electron beams can be moved upwards or downwards and to the left or to the right over the (vertically arranged) display screen. By simultaneously varying the intensity of the beams, a visual presentation of information or a picture can be formed on the display screen. The deflection unit connected around the neck part of the display tube comprises two deflection coil systems to be able to deflect the electron beams in the two directions which are transverse to each other. Each system comprises two coils which are placed on opposite sides of the tube neck, the systems being located 90° around the tube neck with respect to each other. Upon energization of the two deflection coil systems produce orthogonal deflection fields.

Essentially the fields are at right angles to the path of the undeflected electron beams. A conical core of magnetizable material which, when both deflection coil systems are of the saddle type, may be situated tightly around the deflection coil systems, is mostly used to concentrate the deflection fields and to increase the flux density in the region where deflection is performed.

In order to satisfy certain requirements as regards the picture quality, the (dynamic) magnetic deflection fields should often be strongly modulated. For example, the ever more stringent requirements as regards convergence in three-in-line colour television systems necessitate, in addition to a strongly negative magnetic six-pole component in the central region of the field deflection magnetic field, a strong positive magnetic six-pole component on the gun side of the deflection field. The strong positive six-pole component is necessary for field coma correction. (The effect of a positive six-pole component on the dipole deflection magnetic field is a pincushion-shaped field variation). For a self-converging in-line colour system having green as central beam and red and blue as outer beams, coma is to be understood to mean a vertical shift of red and blue with respect to green. If no measures are taken to correct coma, red and blue will be deflected more strongly than green. With a pincushion-shaped deflection magnetic field on the gun side, red and blue experience a weaker deflection field than green. Red and blue will hence be deflected less strongly.

Display devices of the type described in the opening paragraph comprise field deflection coils of the saddle type. They are self-supporting coils which comprise a number of conductors which are wound so as to produce first and second lateral winding packets, an arcuate front end section and an arcuate rear end section which together define a window. In such coils, the rear end sections (at the end adjacent the tube's gun) may be turned up with respect to the profile of the display tube (the original type of saddle coil) or lie parallel (in this type of saddle coil the rear end section follows the tube profile, as it were).

A pincushion-shaped magnetic field is generated when the window apertures of the two saddle coils of a system of deflection coils are large. A barrel-shaped field is generated when the window apertures are small. For a self-converging system the field deflection coil system about its central or middle area must have a barrel-shaped distribution (the individual saddle field deflection coils must thus have a small window aperture), at the gun end a pincushion-shaped distribution (large window aperture), and at the screen end a homogeneous or more or less pincushion-shaped distribution, dependent on how much east-west raster distortion can be tolerated. Similar field distributions are also of importance for monochrome display tube/deflection unit systems which are to have a high resolving power.

It has so far not proved possible to manufacture, by means of the current winding methods, saddle coils having such a strongly varying width of the window aperture as is desired for the said applications. On the other hand, several compromise solutions are known to reduce the problem. For example, a reduced window than is in fact necessary will suffice at the gun end by locally making the field deflection magnetic field pincushion-shaped by means of segments of soft-magnetic metallic material placed within the field deflection coil system, transversely with respect to the direction of the field deflection magnetic field. The use of such segments, however, is detrimental from the energy consumption point of view because they partly screen the generated field. Moreover, their effect is restricted.

It is the object of the invention to provide a coil design for a display system of the kind described in the opening paragraph which leads to the generation of a field deflection field having the field shape desired with respect to self-convergence and east-west distortion, having means on the gun side which intensify the pincushion shape and which do not adversely influence the sensitivity of the field deflection system.

SUMMARY OF THE INVENTION

The invention provides a display device of the type described in the opening paragraph which is characterized in that at the rear end section of the field deflection coil system, which end is adjacent the display tube's gun system, are located first and second 'U' shaped members of soft magnetic material diametrically opposite to each other, each 'U' shaped member comprising a substantially arcuate transverse portion and first and second limbs, each 'U' shaped member bridging corresponding portions of adjacent lateral packets of the first and second field deflection coils with the transverse portion being positioned on the outer surface of said packets while the limbs extend towards the neck of the display tube.

As will be explained hereinafter, such a special use of soft magnetic members which bridge winding conductors of the field deflection coils at their outer surface, and hence are located outside the effective field deflection field, cannot only lead to a desired strong pincushion shape of the field deflection magnetic field at the gun end, but moreover to an increase of the sensitivity of the field deflection coil system. Compared with a conventional deflection unit having coma correction means which are placed in the field deflection magnetic field, the 'U' shaped members that can act as a coma correction means with the present invention can intensify the extent of pincushion shape of a pincushion-shaped field deflection magnetic field generated by the field deflection coils, which the correctors which are used in the conventional deflection unit cannot do.

In one embodiment each field deflection coil may consist of a main coil and a sub coil arranged axially in the longitudinal direction with the sub coil adjacent the display tube's gun system, the rear end section of said field deflection coil system being located on the sub coils while the front end section is located on the main coils, the 'U' shaped members bridging portions of said sub coils. The use in such a deflection coil system of the members of a soft magnetic material in the manner according to the invention leads to the production of a very strong pincushion-shaped magnetic field distribution at the gun end.

An alternative field deflection coil system in which the invention can be used advantageously and which has the advantage that the individual coils do not each consist of a main and a sub coil but of one single coil is where the conductors of each field deflection coil additionally form third and fourth lateral winding packets, as well as second front and rear end sections which together define a second window located within the first mentioned window and where the first mentioned rear end section is remote from the second window. This latter field deflection coil system may consist, as it were, of coils having two sets of winding packets which at the gun end have different lengths. The outer packet having the larger window aperture continues farthest at the gun end as a result of which a pincushion-shaped field is produced at the gun end. The inner winding packet at its gun end has a smaller window aperture as a result of which the assembly about the central region of the deflection field does not produce a pincushion-shaped field but a strong or very strong barrel-shaped field. This smaller window aperture widens in the direction of the display screen in order that at the screen end of the deflection field a homogeneous or a strong or very strong pincushion-shaped deflection field is produced. This latter field depends on the extent of widening. In this case also, two soft magnetic members can advantageously be arranged in the manner described in order that the pincushion shape of the magnetic field at the gun end be still intensified.

The invention also relates to a deflection unit for use with a display device as described hereinbefore.

The invention will now be described by way of example in greater detail with reference to the accompanying drawings.

FIGS. *7a* and *7b* show with reference to cross-sectional views through a display tube the construction of a line deflection field.

FIGS. *8a*, *8b* and *8c* show with reference to cross-sectional views through a display tube the construction of a field deflection field having a pincushion-shaped distribution.

FIGS. *9a*, *9b* and *9c* show with reference to cross-sectional views through a display tube the construction of a field deflection field having a barrel-shaped distribution.

DETAILED DESCRIPTION OF THE PREFERRED EMBODIMENTS

Figures 1, 2:
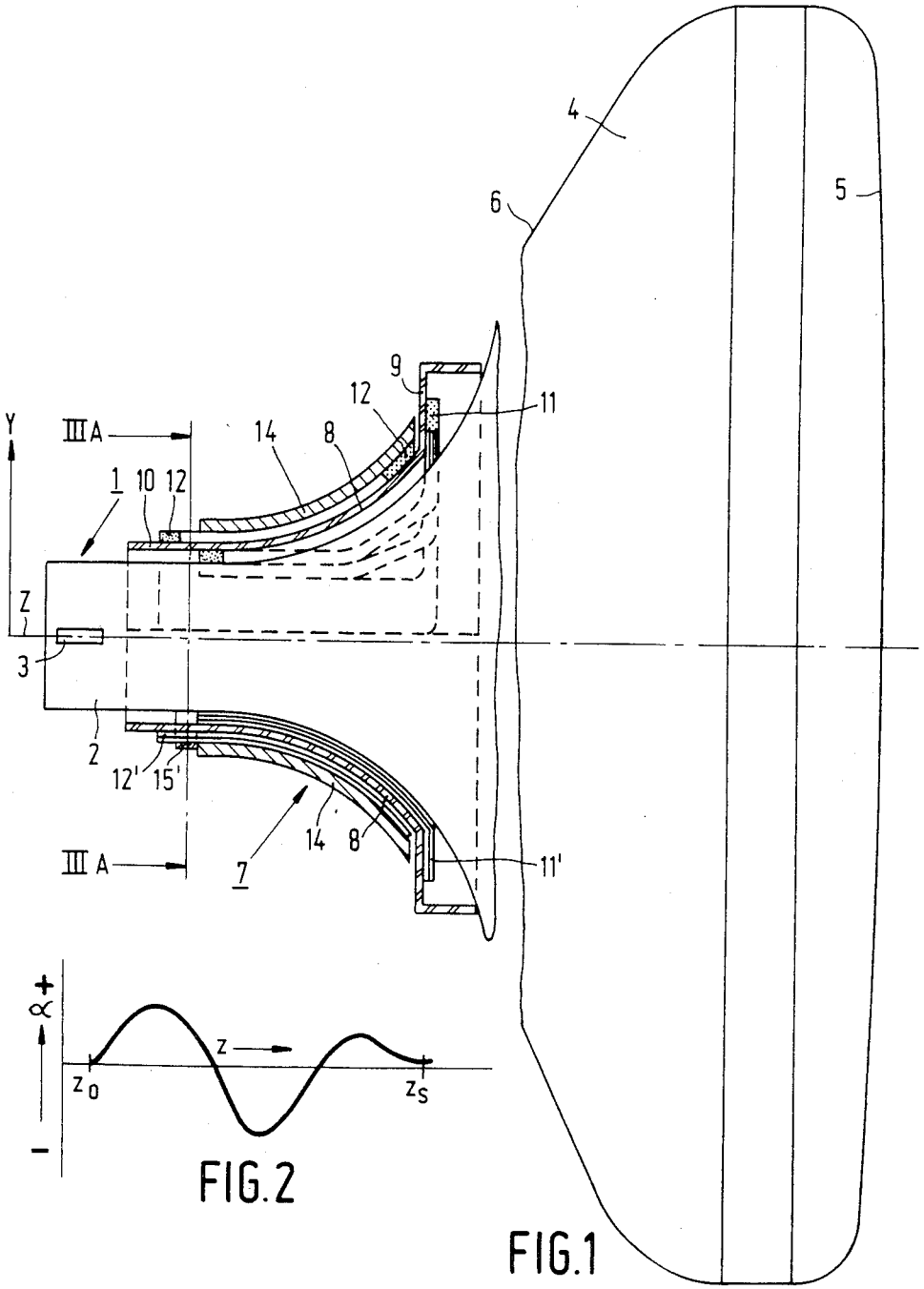
FIG. 1 is a diagrammatic cross-sectional view (taken along the y-z plane) of a display device according to the invention having a cathode ray tube with a deflection unit mounted thereon.
FIG. 2 shows with reference to the parameter $\alpha$ the six-pole component of a deflection field which determines the extent of pincushion shape and barrel shape, respectively, transverse to the z-axis of a field deflection magnetic field produced by means of a field deflection coil system used with the invention.

FIG. 1 is a cross-sectional view of a display device comprising a cathode-ray tube 1 having an envelope 6 varying from a narrow neck portion 2 in which an electron gun system 3 is mounted, to a wide cup- or cone-shaped portion 4 which has a display screen 5. On the tube, a deflection unit 7 is mounted at the transition between the narrow and wide portions. The said deflection unit 7 comprises a support 8 of insulating material having a front end 9 facing the tube's display screen 5 and a rear end 10 adjacent the tube's gun system 3. Positioned between the said ends 9 and 10 on the inside of the support 8 is a deflection coil system 11, 11' for generating a (line) deflection field for deflecting in a horizontal direction the electron beams generated by the electron gun system 3. On the outside of the support 8 is positioned a further deflection coil system 12, 12' for generating a (field) deflection field for deflecting in a vertical direction the electron beams produced by the electron gun system 3. The deflection coil systems 11, 11' and 12, 12' are surrounded by an annular core 14 of a magnetizable material. The individual coils 12, 12' of the field deflection coil system, as well as the coils 11, 11' of the line deflection coil system are of the saddle type with rear end sections which substantially follow the contour of the tube's neck portion and are not bent away therefrom.

The invention relates in general to the production of a field deflection field having a magnetic field distribution as shown in FIG. 2.

FIG. 2 shows, with reference to the parameter $\alpha$, the six-pole component of a field deflection magnetic field which can be produced by the field deflection coil system 12, 12'. A positive value of the six-pole component occurs at the gun end ($z=z_o$) and at the screen end ($z=z_s$) of the deflection field, a negative value of $\alpha$ occurs about the central region of the deflection field. As will be explained hereinafter, this means that the deflection field at the gun end is pincushion-shaped, is barrel-shaped about the central region, and is pincushion-shaped at the screen end.

Figure 3A:
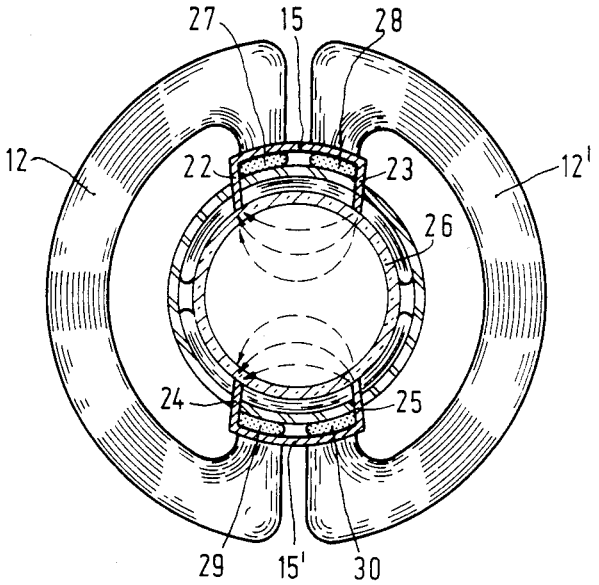
FIG. 3A is an elevation of a sectional view taken along the line IIIA—IIIA of FIG. 1.
Figure 4:
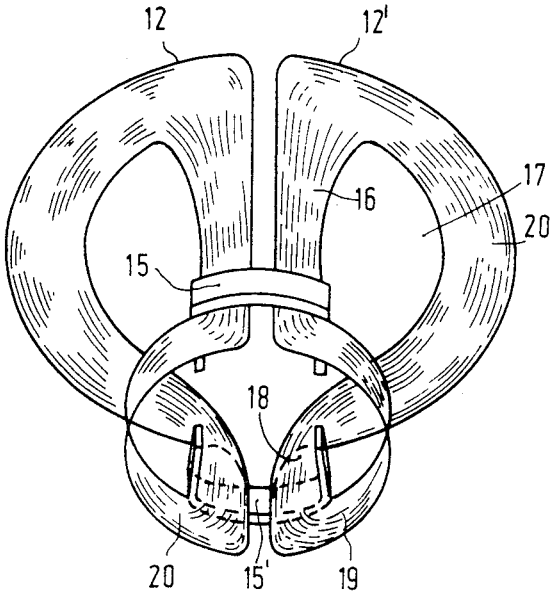
FIG. 4 is a perspective rear view of a field deflection coil system which can be used with the invention.

FIG. 4 is a perspective view of the field deflection coil system 12, 12' of FIG. 1 viewed from the gun end. Coil 12' is constructed from a first lateral winding packet 16, a second lateral winding packet 18, a rear end section 19 and a front end section 20 which together define a window 17. The rear end section 19 is of a shape such that it substantially follows the contour of the tube's envelope at the neck portion whilst the front end section is bent so as to follow the shaping of the tube's envelope at its cone-shaped portion. Coil 12 is constructed in the same manner as coil 12' with corresponding shapings for its front and rear end sections. In order to make the pincushion shape of the deflection produced upon energization at the end of smaller diameter (the gun end) as large as is required, the field deflection coil system 12, 12' comprises magnetic field conductors in the form of 'U' shaped members or segments 15, 15'. These members 15, 15' are of a soft magnetic material having a substantially arcuate transverse portion and first and second limbs 22, 23 and 24, 25 respectively as shown in FIG. 3A, which extend as far as possible towards the glass of the envelope of the display tube 26 through the rear end (10) of the support (8). The magnetic conductors 15, 15' are provided so that, at the end of the smaller diameter, they bridge the outer surface of adjacent lateral packets of current conductors 27, 28 and 29, 30 of the coils 12, 12'. This means that they bridge a lateral packet of current conductors of coil 12 and a lateral packet of current conductors of coil 12'. In this manner, the magnetic field (which lines are shown by broken lines) are concentrated between the limbs 22, 23 and 24, 25 of the members 15, 15'. As a result of this the magnetic field becomes more pincushion-shaped at the gun end than in the case in which the members 15, 15' are absent and an effective coma correction is realized.

Figure 3B:
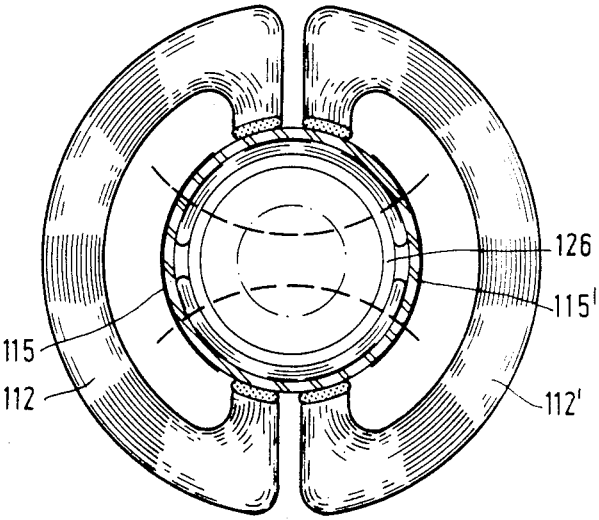
FIG. 3B is a corresponding elevation of a sectional view through a conventional display device.

A comparison of FIG. 3A with FIG. 3B shows that an improvement is also achieved with respect to prior systems having coma correcting segments which are placed in the field deflection magnetic field. FIG. 3B shows such a prior system where field deflection coils 112, 112' are placed around a display tube 126. Segments 115, 115' of soft magnetic material bent substantially to the shape of the tube's envelope at the neck end are positioned in the magnetic field which is produced by the coils 112, 112'. The maximum effect of the segments 115, 115' is that in their position in the field they cause the shown (broken-line) magnetic field lines to extend at right angles to their surfaces. However if the circle is considered which is located with the tube's envelope (dot-and-dash lines), then the magnetic field lines as they disect the circle are no longer at right angles thereto. Hence, the further one goes into the tube's neck the pincushion shape of the magnetic field decreases. In other words, if the field is already pincushion-shaped to a maximum in the place where the segments 115, 115' are provided, then they produce no effect. In contrast herewith, the members 15, 15' are previously described do intensify the pincushion shape.

Further advantages are that the field deflection system becomes more sensitive because the members 15, 15' cause the field to be concentrated in a smaller volume. As a matter of fact, little or no magnetic field is present outside the segments 15, 15'. As a result of this the ring or core 14 of soft-magnetic material (FIG. 1) may be shorter than in existing systems: it need not be longer than the line deflection coil system 11, 11'.

Figure 5:
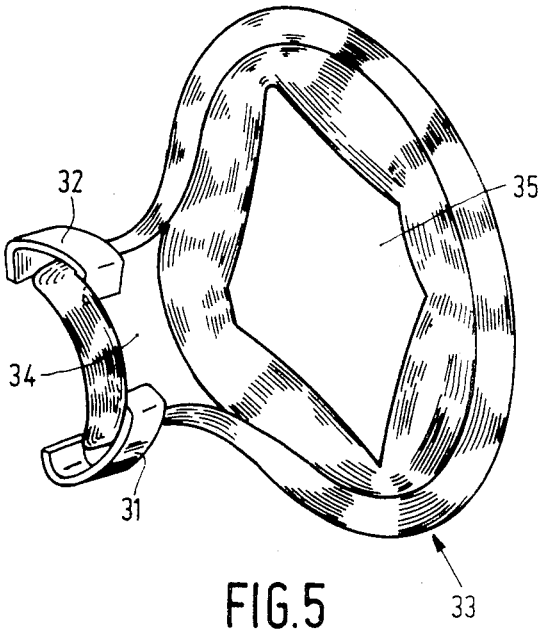
FIG. 5 is a perspective view of one half of an alternative field deflection coil system.
Figure 6:
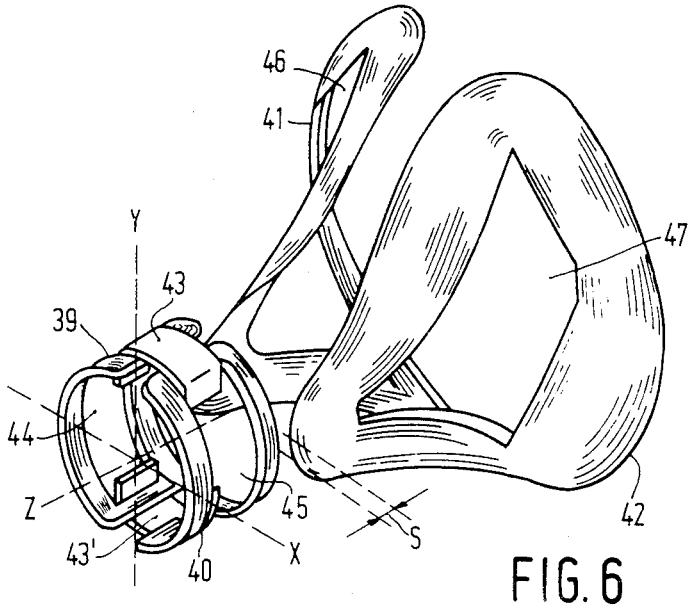
FIG. 6 is a perspective rear view of a further field deflection coil system which can be used with the invention.

Field deflection coil systems comprising magnetic conducting members 15, 15' may have different constructions to that shown in FIG. 4, two such different constructions being shown in FIGS. 5 and 6.

FIG. 5 shows the use of magnetic conductors 31, 32 which bridge the outside of conductor packets in a field deflection coil system having a pair of coils each of the type denoted by reference numeral 33. These are coils having a first (outer) window 34 located within which is a second (inner) window 35. Since the outer window 34 at the end of smaller diameter (gun end) extends further, the window aperture there is large and a field deflection magnetic field having a strong pincushion-shaped variation may be produced at that end. About the center the inner window 35, which has a smaller aperture, plays a particular role. The "average" aperture thus is relatively small in the central region so that a deflection field having a barrel-shaped variation is produced there. The pincushion-shaped field which is generated at the end of smaller diameter by means of a coil system having such coils and which in itself is already strongly pincushion-shaped, is still intensified by the presence of the members 31, 32 of soft-magnetic material.

FIG. 6 shows a field deflection coil system formed by two sub-deflection coils 39, 40 which form a sub-deflection coil unit facing the gun system (3) and two main deflection coils 41, 42 which form a main deflection coil unit facing the display screen (4). An annular core of soft-magnetic material is to be placed as before coaxially around the field deflection coil which in the FIG. 6 is shown composed of coils of the saddle type. The (rear) sub-coils 39 and 40 are each formed by curved rectangular windings which enclose windows 44 and 45, respectively. Upon energization they together generate a dipole field with a strong six-pole component which is further intensified by providing soft magnetic members 43, 43' which are positioned on the outside of adjacent members of coils 39, 40 as shown to bridge these members. As a result of this the window apertures 44, 45 may be rectangular, hence of simple shape. In order to be able to produce an equally strong six-pole component without the presence of members 43, 43' it would have been necessary to use such a complicated (eight-shaped) shape that the manufacture of the sub-coils 39, 40 becomes too complicated. The (front) main coils 41 and 42 are formed by winding packets of wires which enclose windows 46 and 47, respectively. Essentially, the window apertures are of a triangular shape having the apex of the triangle directed towards the rear sub-coils 39, 40 so as to be able to produce, upon energization, a dipole field in combination with, from the rear to the front, a negative six-pole field and a positive six-pole field, respectively. As a result of this, the resulting field deflection field has a six-pole component which is strongly negative in the central region of the deflection field (so that astigmatism errors are at a minimum) is strongly positive at the gun end (so that coma errors are at a minimum) and is sufficiently positive at the screen end to make east-west raster distortion as small as possible.

A particular aspect of the use of deflection coils of the FIG. 6 type is that, by varying the distance S between the front main-coil unit 41, 42 and the rear sub-coil unit 39, 40, the effect of the negative six-pole field in the central region can be made larger or smaller. Herewith it is possible to correct astigmatism errors to a considerable extent.

So in this case the (rear) sub-coils 39 and 40 are each constructed as rectangular saddle coils having two longitudinal lateral winding packets separated from each other in the circumferential direction and connection packets situated on both their front and on their rear side in a plane parallel to the tube envelope. The (front) main coils 41, 42 are each constructed as saddle coils having two lateral winding packets separated from each other in the circumferential direction and also connection packets situated on their rear side in a plane parallel to the tube envelope.

The terms relating to deflection fields as used hereinbefore will be explained with reference to FIGS. 7, 8 and 9.

Figure 7:
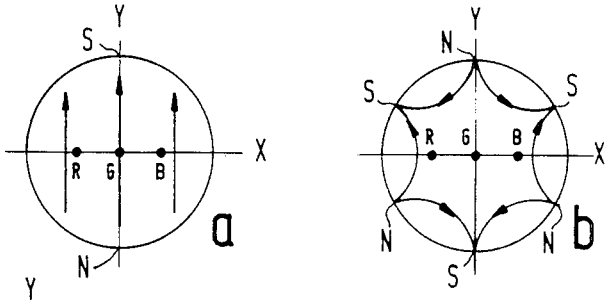

FIG. 7 represents sectional views through a display tube taken along a plane at right angles to the z-axis. Electron beams generated in the display tube are denoted by R, G and B. The arrows in part A of FIG. 7 represent the dipole line deflection magnetic field. In the case of the orientation shown of the line deflection field, deflection of the electron beams will take place to the right. The three electron beams hence are located in the same plane as the plane in which deflection takes place. The arrows in part b of FIG. 7 represent a six-pole field. The orientation of the six-pole field is such that the side beams R and B experience an extra deflection with respect to the central beam in the plane in which they are situated. In such a case the six-pole field is defined as a positive six-pole (line deflection) field. A six-pole field having an orientation which causes the outer beams to experience a smaller deflection than the central beam in the plane in which they are situated, is defined as a negative (line deflection) field. When defining the sign of a six-pole field deflection field reference is always made to the situation in a line deflection field.

Figure 8:
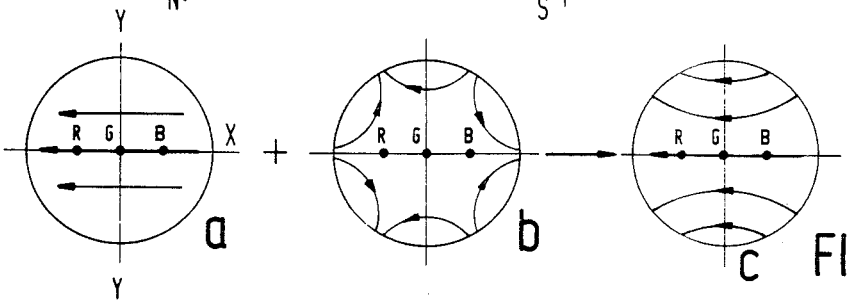

FIG. 8 also represents sectional views through a display tube taken along a plane at right angles to the z-axis. The arrows in part a of FIG. 8 represent the dipole field deflection magnetic field. In the case of orientation of the dipole deflection field shown, deflection of the electron beams R, G and B will take place upwards. In this case the three electron beams are hence situated in a plane at right angles to the plane in which the deflection takes place. The arrows in part b of FIG. 8 represent a six-pole field. The orientation of the six-pole field in part b of FIG. 8 is such that, referring back to the comparable situation in a line deflection field (for that purpose turn parts a and b of FIG. 8 a quarter of a turn to the right), said six-pole field is termed positive. Part of FIG. 8 shows the resulting field deflection field which is pincushion-shaped.

Figure 9:
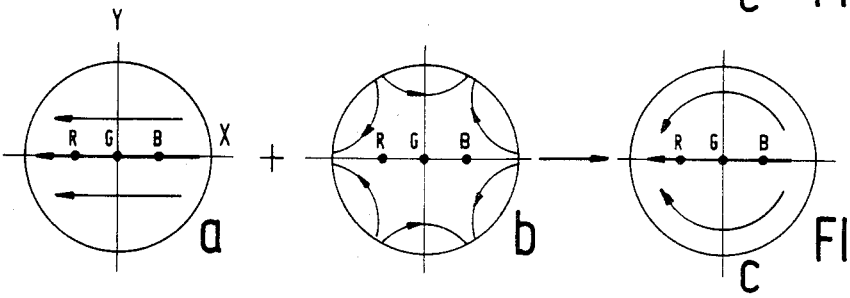

FIG. 9 is also a sectional view through a display tube taken along a plane at right angles to the z-axis. The arrows in part a of FIG. 9 represent the dipole field deflection magnetic field. In the case of the orientation shown of the dipole deflection field, deflection of the electron beams R, G and B will take place upwards. So the three electron beams are situated in a plane at right angles to the plane in which deflection takes place. The arrows in part b of FIG. 9 represent a six-pole field. The orientation of the six-pole field in FIG. 9B is such that, referring back to the comparable situation in a line deflection field, said six-pole field is termed negative. In part c of FIG. 9 the resulting field deflection field is shown which is barrel-shaped.

What is claimed is:

1. A device for displaying television pictures comprising a display tube the neck of which contains an electron gun system for emitting at least one electron beam towards a display screen and a deflection unit which is mounted coaxially about the display tube, which deflection unit comprises a line deflection coil system which when energized deflects the electron beam(s) in a first direction and a field deflection coil system which when energized deflects the electron beam(s) in a second direction transverse to the first direction, the said field deflection coil system comprising two field deflection coils each of the saddle type situated diametrically with respect to each other, each deflection coil comprising a plurality of conductors forming first and second lateral winding packets substantially extending in the longitudinal direction of the deflection unit which substantially coincides with the direction of the longitudinal axis of the display tube, an arcuate front end section and an arcuate rear end section which together define a window, to wherein at the rear end section of the field deflection coil system which end is adjacent the display tube's gun system are located first and second 'U' shaped members of soft magnetic material diametrically opposite to each other, each 'U' shaped member comprising a substantially arcuate transverse portion and first and second limbs, each 'U' shaped member bridging corresponding portions of adjacent lateral packets of the first and second field deflection coils with the transverse portion being positioned on the outer surface of said packets while the limbs extend towards the neck of the display tube.

2. A device as claimed in claim 1, wherein each field deflection coil consists of a main coil and a sub-coil arranged axially in the longitudinal direction with the sub-coil adjacent the display tube's gun system, the rear end section of said field deflection coil system being located on the sub-coils while the front end section is located on the main coils, and the 'U' shaped members bridging portions of said sub-coils.

3. A device as claimed in claim 1, wherein the conductors of each field deflection coil additionally form third and fourth lateral winding packets and second front and rear end sections which together define a second window located within the first mentioned window, the first mentioned rear end section being remote from said second window.

4. A device as claimed in claim 1, to wherein said field deflection coils are such that when energized they produce a pincushion-shaped magnetic field distribution at the end facing the display tube's screen, a barrel shaped magnetic field distribution about the middle of the deflection unit and in combination with the said 'U' shaped members a pincushion-shaped magnetic field distribution at the end adjacent the display tube's gun system.

5. A device as claimed in claim 2 wherein said field deflection coils are such that when energized they produce a pincushion-shaped magnetic field distribution at the end facing the display tube's screen, a barrel shaped magnetic field distribution about the middle of the deflection unit and in combination with the said 'U' shaped members a pincushion-shaped magnetic field distribution at the end adjacent the display tube's gun system.

6. A device as claimed in claim 3 wherein said field deflection coils are such that when energized they produce a pincushion-shaped magnetic field distribution at the end facing the display tube's screen, a barrel shaped magnetic field distribution about the middle of the deflection unit and in combination with the said 'U' shaped members a pincushion-shaped magnetic field distribution at the end adjacent the display tube's gun system.

* * * * *